US005586757A

United States Patent [19]

Nakamatsu et al.

[11] Patent Number: 5,586,757

[45] Date of Patent: Dec. 24, 1996

[54] PAPER REGULATING MECHANISM AND PAPER CASSETTE

[75] Inventors: Yasuhiro Nakamatsu; Masao Otsuka; Fumio Hatanaka; Arihiro Tsunoda, all of Osaka, Japan

[73] Assignee: Mita Industrial Co., Ltd., Osaka, Japan

[21] Appl. No.: 372,048

[22] Filed: Jan. 12, 1995

[30] Foreign Application Priority Data

Jan. 14, 1994 [JP] Japan ..... 6-002813
Jan. 14, 1994 [JP] Japan ..... 6-002814

[51] Int. Cl.[6] ..... B65H 1/04

[52] U.S. Cl. ..... 271/145; 271/171

[58] Field of Search ..... 271/145, 207, 271/171, 243, 244; 221/44, 241

[56] References Cited

U.S. PATENT DOCUMENTS

| | | | |
|---|---|---|---|
| 3,934,870 | 1/1976 | Miller et al. | 271/171 |
| 4,032,137 | 6/1977 | Katayama et al. | 271/145 |
| 4,343,461 | 8/1982 | Tomimori et al. | 271/171 |
| 4,506,442 | 3/1985 | Alzmann et al. | 271/171 |
| 4,874,160 | 10/1989 | Yamamoto | 271/227 |
| 5,071,111 | 12/1991 | Iwamoto et al. | 271/145 |

FOREIGN PATENT DOCUMENTS

| | | | |
|---|---|---|---|
| 0285454 | 10/1988 | European Pat. Off. . | |
| 0537562 | 4/1993 | European Pat. Off. . | |
| 55-84730 | 6/1980 | Japan . | |
| 48506 | 6/1985 | Japan | 271/145 |
| 48511 | 11/1985 | Japan | 271/145 |
| 48706 | 6/1987 | Japan | 271/145 |
| 62-275932 | 11/1987 | Japan . | |
| 49310 | 10/1993 | Japan | 271/145 |

*Primary Examiner*—William E. Terrell
*Assistant Examiner*—T. Kelly
*Attorney, Agent, or Firm*—Ratner & Prestia

[57] ABSTRACT

Paper regulating mechanism in a paper feed cassette for accommodating paper sheets , has: a regulation guide plate disposed below a bottom plate, on which are placed the paper sheets, and formed with a slit having a predetermined width; upper plate-shaped portions against which the paper sheets come into abutment; lower guided portions disposed at the lower ends of said upper plate-shaped portions and so loosely fitted in said slit as to easily move; rollers connected to said upper plate-shaped portions or said lower guided portions and rotatably abutting against said regulating guide plate; and lock members for fixing said upper plate-shaped portions in arbitrary positions with respect to said regulation guide plate.

5 Claims, 7 Drawing Sheets

PAPER REGULATING MECHANISM AND PAPER CASSETTE

BACKGROUND OF THE INVENTION

1. Field of the Invention

The present invention relates to a paper regulating mechanism and a paper cassette in a paper feed cassette mounted in a copying machine, for example, for accommodating sheets of copying paper.

2. Related Art of the Invention

In the prior art, for example, a copying machine is equipped with several paper feed cassettes, as shown in FIG. 2, for accommodating paper sheets having a plurality of sizes simultaneously. These paper feed cassettes are coarsely divided into the type, in which the size of paper to be accommodated is fixed, and the type in which the size of paper to be accommodated can be freely set.

A copying machine 101, as shown in FIG. 2, is equipped with the paper feed cassette of the latter type, the construction of which will be described in the following with reference to FIGS. 2 and 3.

Here, FIG. 2 is a partially cut-away section showing a side view of the body of copying machine 101, and FIG. 3 is a schematic perspective view of the paper feed cassette shown in FIG. 2.

In FIG. 2, a first paper feed cassette 105 is one capable of accommodating the paper sheets 104 of any size if the size falls within the size range of A3 to B5. This first paper feed cassette 105 is slidably disposed in the central portion of the copying machine 101. A front panel 103 is attached to the front face of the first paper feed cassette 105 and equipped with a knob portion 103*a* which is used to pull the first paper feed cassette 105 toward the operator standing in front. The portion in the first paper feed cassette 105 for accommodating the paper sheets 104 is arranged, as will be described hereinafter, with a bottom plate 111 for placing the paper sheets 104 and a pair of paper regulating plates 112 (for regulating the side portions) made horizontally movable for preventing the paper sheets 104 from slipping in a direction perpendicular to the paper feeding direction.

A second paper feed cassette 106 and a third paper feed cassette 107 are given constructions similar to that of the first paper feed cassette 105 and are slidably disposed below the first paper feed cassette 105.

Next, as shown in FIG. 3, the bottom plate 111 is a plate for setting the paper sheets 104 and is formed in predetermined portions with a pair of openings 114. The paper regulating plate 112 has its side face formed into a generally letter "L" shape, of which a horizontal portion is extended to form a rack portion 112*a* at its one side whereas a vertical portion is formed into a paper regulating portion 112*b* arranged to extend through the opening 114. Moreover, the paired paper regulating plates 112 are constructed to face the individual paper regulating portions 112*b* and the portions of the individual rack portions 112*a*.

Between the rack portions 112*a* having their portions facing each other, there is rotatably arranged a pinion portion 113. These components are constructed to mesh each other completely without any idle motion thereby to move the paired paper regulating plates 112 the same distance in the direction perpendicular to the paper feeding direction.

In the individual paper feed cassettes equipped with the paper regulating mechanisms thus constructed, the following operations are usually performed in case: the first paper feed cassette 105 is charged with the paper sheets of A4 size; the second paper feed cassette 106 is charged with the paper sheets of B4 size; and the third paper feed cassette 107 is charged with the paper sheets of A3 size, and in case the operator is about to change the sizes of paper sheets already accommodated.

Specifically, the operator pulls the second paper feed cassette 106 to his side (as shown in FIG. 2) by inserting his hand into the knob portion 103*a* so that the paper sheets 104 of B4 size accommodated in the second paper feed cassette 106 may be renewed by those of B5 size. The paper sheets 104 of B4 size accommodated in advance in the second paper feed cassette 106 pulled out are removed, and a predetermined number of paper sheets 104 of B5 size are placed on the bottom plate 111 in a generally central portion of the paired paper regulating plates 112, as shown in FIG. 3. In order to narrow the gap between the paired paper regulating plates 112 to the width of the paper sheets, moreover, the individual paper regulating portions 112*b* are manually moved toward each other by a predetermined force and are stopped at positions corresponding to the width of the paper sheets of B5 size. As a result, the positions of the paper sheets 104 of B4 size can be properly regulated.

Thus, the paper regulating mechanism must accomplish the different functions of preventing the paper sheets 104 from slipping during a copying operation while permitting the paper regulating plates 112 to be moved manually when replacing the paper sheets 104. The prior art of the paper feeding mechanism is disclosed in Japanese Patent Laid-Open No. 21850/1979 or Japanese Utility Model Laid-Open No. 62739/1982, for example.

Even if, however, the prior art paper regulating plates 112 are made to prevent the paper sheets 104 from slipping, they still must be able to be moved by a predetermined manual force. As a result, paper slip prevention is limited in prior art copying machines 101 since if excessive forces are used when loading or unloading the paper cassette, for example, this force may cause the regulating plates 112 to move, thereby permitting the paper sheets 104 to move from their normal output position such that normal copying operations are made more difficult, if not impossible.

As a method for solving this problem, there has been proposed and utilized a structure in which the paper regulating plates 112 are equipped with a lock mechanism for fixing the plates 112 more reliably to prevent any movement of them. As a result, if the lock mechanism is released at the time of exchanging the paper sheets 104, the paper regulating plates 112 can be manually moved as in the prior art. During the copying operation, moreover, the paper regulating plates 112 can be locked to prevent the slip of the paper sheets 104.

This construction, however, stresses preventing slipping of the paper sheets 104 to the detriment of being able to manually move the paper regulating plates 112 easily when exchanging the paper sheets to the extent that in the prior art, it was sufficient if the plates 112 could be moved at all.

Thus, in these prior art paper cassettes, although the paper sheets 104 could be reliably fixed to prevent the paper sheets from slipping (except for the case when the paper sheets 104 are to be exchanged), there still existed the need for the ability to move the paper regulating plates 112 smoothly and without great force when exchanging the paper sheets 104.

On the other hand, in the paper cassette of the prior art disclosed in Japanese Utility Model Publication No. 120732/1984, for example, a pin for mounting a paper stopper is inserted and retained in a mounting hole formed in the bottom face of the paper cassette, and the mounting hole is formed in a plurality of positions for the paper sheets of individual sizes so that the mounting position of the paper stopper is changed in conformity to the size of the paper sheets to be used (as corresponds to the paper regulating plates for the rear portions).

These prior art cassettes, however, have the problem that it is difficult to move the paper stopper when changing the paper size. Specifically, it is cumbersome to insert and remove the mounting pin of the paper stopper into and out of the mounting hole, respectively. Moreover, in order to securely fix the paper stopper, the fit between the mounting pin and the mounting hole has to be considerably tight. This arrangement, however, makes the mounting and demounting the paper stopper even more difficult. Furthermore, the paper stopper may be lost or damaged when it is removed. Another drawback of this arrangement is that the number of paper sizes which can be used is limited to the predetermined mounting hole positions where the paper stopper can be inserted.

Considering those problems of the paper regulating mechanism and the paper stopper of the prior art, the present invention has an object to provide a paper regulating mechanism and a stopper, which can move the paper regulating plate and the stopper smoothly by a weak force to make the paper exchanging operations easier than those of the prior art and to prevent the slip of the paper sheets reliably.

SUMMARY OF THE INVENTION

According to the present invention, there is provided a paper regulating mechanism in a paper feed cassette for accommodating paper sheets, which mechanism comprises: a regulation guide plate disposed below a bottom plate, on which are placed the paper sheets, and formed with a slit having a predetermined width; upper plate-shaped portions against which the paper sheets come into abutment; lower guided portions disposed at the lower ends of the upper plate-shaped portions and so loosely fitted in the slit as to easily move; rollers connected to the upper plate-shaped portions or the lower guided portions and rotatably abutting against the regulating guide plate; and lock means for fixing the upper plate-shaped portions in arbitrary positions with respect to the regulation guide plate.

In the present invention, the regulation guide plate is disposed below the bottom plate, on which are placed the paper sheets, and is formed with the slit having a predetermined width, and the paper sheets are in abutment against the upper plate-shaped portions whereas the lower guided portions are formed at the lower ends of the upper plate-shaped portions and so loosely fitted in the slit that they can easily move. The rollers are connected to the upper plate-shaped portions or the lower guided portions and in rotatable abutment against the regulating guide plates, and the lock means can lock the upper plate-shaped portions in an arbitrary position with respect to the regulation guide plate. As a result, the paper sheets of a predetermined size are placed on the bottom plate, and the smoothly movable upper plate-shaped portions are brought into abutment against the paper sheets of the predetermined size by the rolling motions of the rollers until the upper plate-shaped portions are fixed by the lock means.

According to the present invention, moreover, there is provided a paper cassette comprising: a paper cassette body for accommodating stacked paper sheets; a paper stopper for abutting against the end portions of the paper sheets stacked in the paper cassette body; and a support shaft horizontally extending in a through groove formed in the bottom portion of the paper cassette body, wherein the paper stopper includes a paper abutment portion erected upright, and a sliding sleeve fitted on the support sleeve at the lower end of the paper abutment portion, wherein the sliding sleeve has clamping members separated by axial slits from the cylindrical face thereof, wherein a control lever has its cylindrical fitting portion fitted rotatably on the outer circumferences of the clamping members, and wherein the cylindrical fitting portion is formed with push projections raised radially inward from the inner face of the cylindrical fitting portion.

In the present invention, the sliding sleeve, i.e., the paper stopper can freely move along the support shaft unless the push projections formed on the cylindrical fitting portion of the control lever are in abutment against the clamping members of the sliding sleeve while the sliding sleeve of the paper stopper being fitted on the support shaft of the paper cassette. In other words, the position of the paper abutment portion of the paper stopper can be set in an arbitrary position along the support shaft. In short, the position of the paper stopper can be freely changed while being mounted on the paper cassette. If the control lever is turned after the position of the paper stopper has been adjusted to the paper size, the push projections of the cylindrical fitting portion are circumferentially moved to abut against the outer circumferences of the clamping members of the sliding sleeve. When the push projections come into abutment for the pushing actions, the clamping members are deformed toward the center to push their inner faces onto the support shaft. As a result, the sliding sleeve is clamped and fixed on the support shaft so that the paper stopper is fixed in that position.

In case the paper size is to be changed, the control lever is turned in the direction opposite to the aforementioned fastening direction. Then, the push projections come out of engagement from the outer circumferences of the clamping members so that the clamping force applied from the clamping members to the support shaft disappears. As a result, the sliding sleeve can freely move with respect to the support shaft so that the position of the paper stopper can be changed.

BRIEF DESCRIPTION OF THE DRAWINGS

FIG. 1(*b*) is a schematic top plan view, as taken in the direction of arrow A showing the stepped roller of FIG. 1(*a*).

Designations of Reference Characters

| | |
|---|---|
| 1 | Axis of Symmetry |
| 2 | Regulation Guide Plate |
| 3 | Slit |
| 4 | Stepped Roller |
| 5 | Holding Pin |
| 6 | Bracket |
| 7 | Lever |
| 7a | Hinge Pin |
| 8 | Protection Portion |
| 9 | Slip Stopping Member |

-continued

| | |
|---|---|
| 10 | Lock Spring |
| 11 | Roller |
| 11a | Roller Shaft |
| 101 | Copying Machine |
| 103 | Front Panel |
| 103a | Knob Portion |
| 104 | Paper Sheet |
| 105 | First Paper Feed Cassette |
| 106 | Second Paper Feed Cassette |
| 107 | Third Paper Feed Cassette |
| 111 | Bottom Plate |
| 112 | Paper Regulating Plate |
| 112a | Rack Portion |
| 112b | Paper Regulating Portion |
| 113 | Pinion Portion |
| 114 | Opening |

Figure 4:
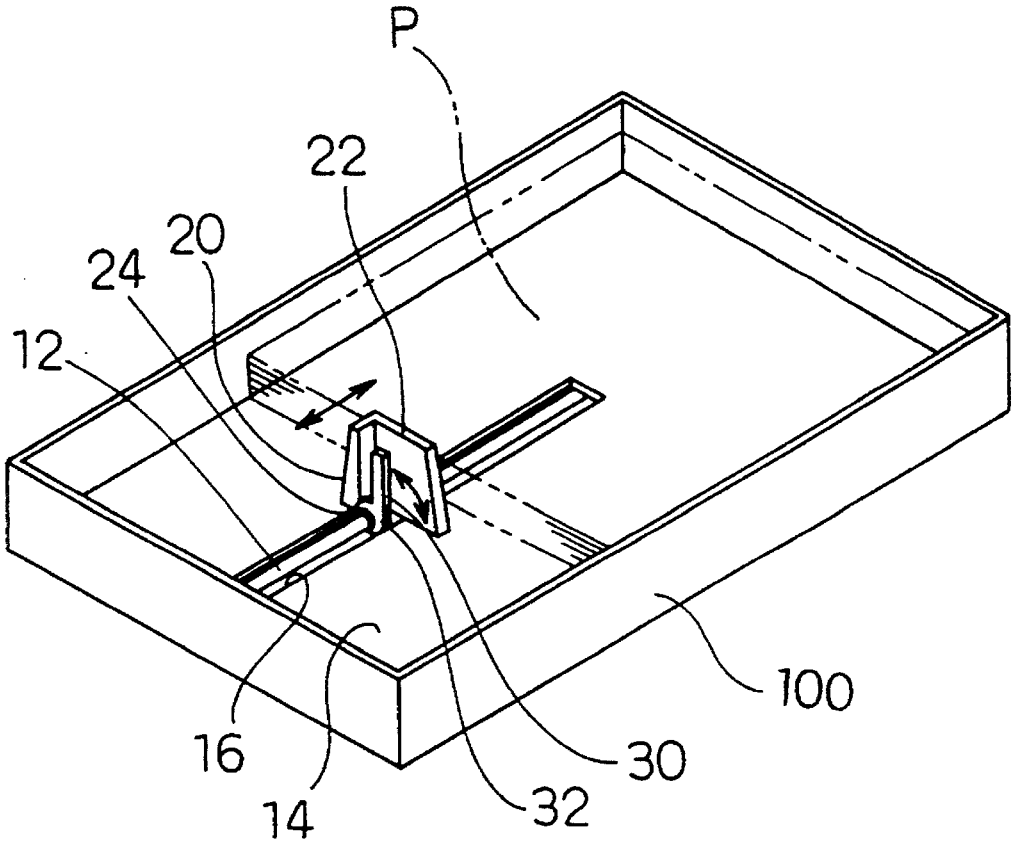

FIG. 4 is a perspective view showing a paper cassette according to an embodiment of the present invention.

Figure 5:
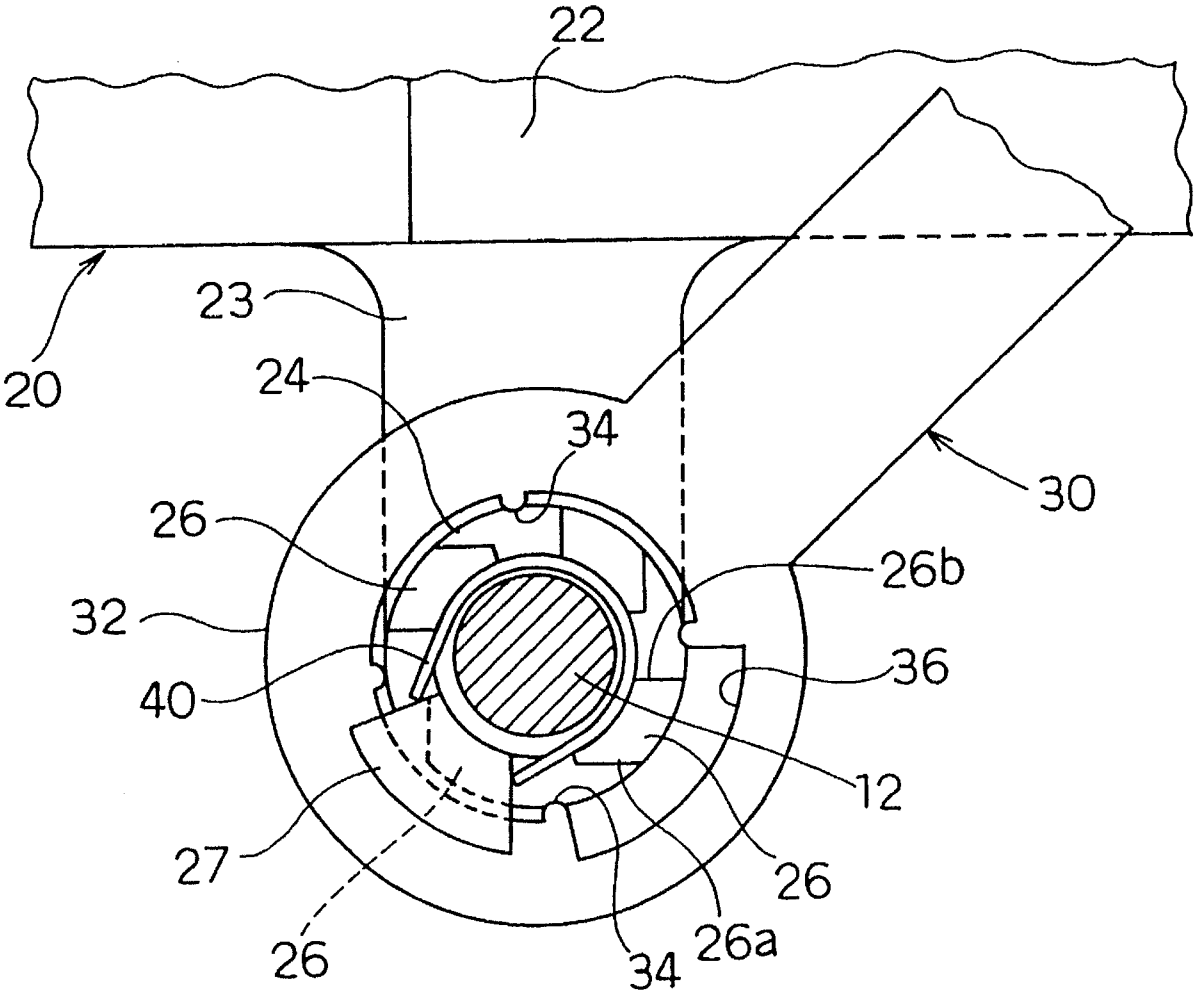

FIG. 5 is an enlarged section of an essential portion of the invention showing the mounting structure of a paper stopper shown in FIG. 4.

Figure 2:
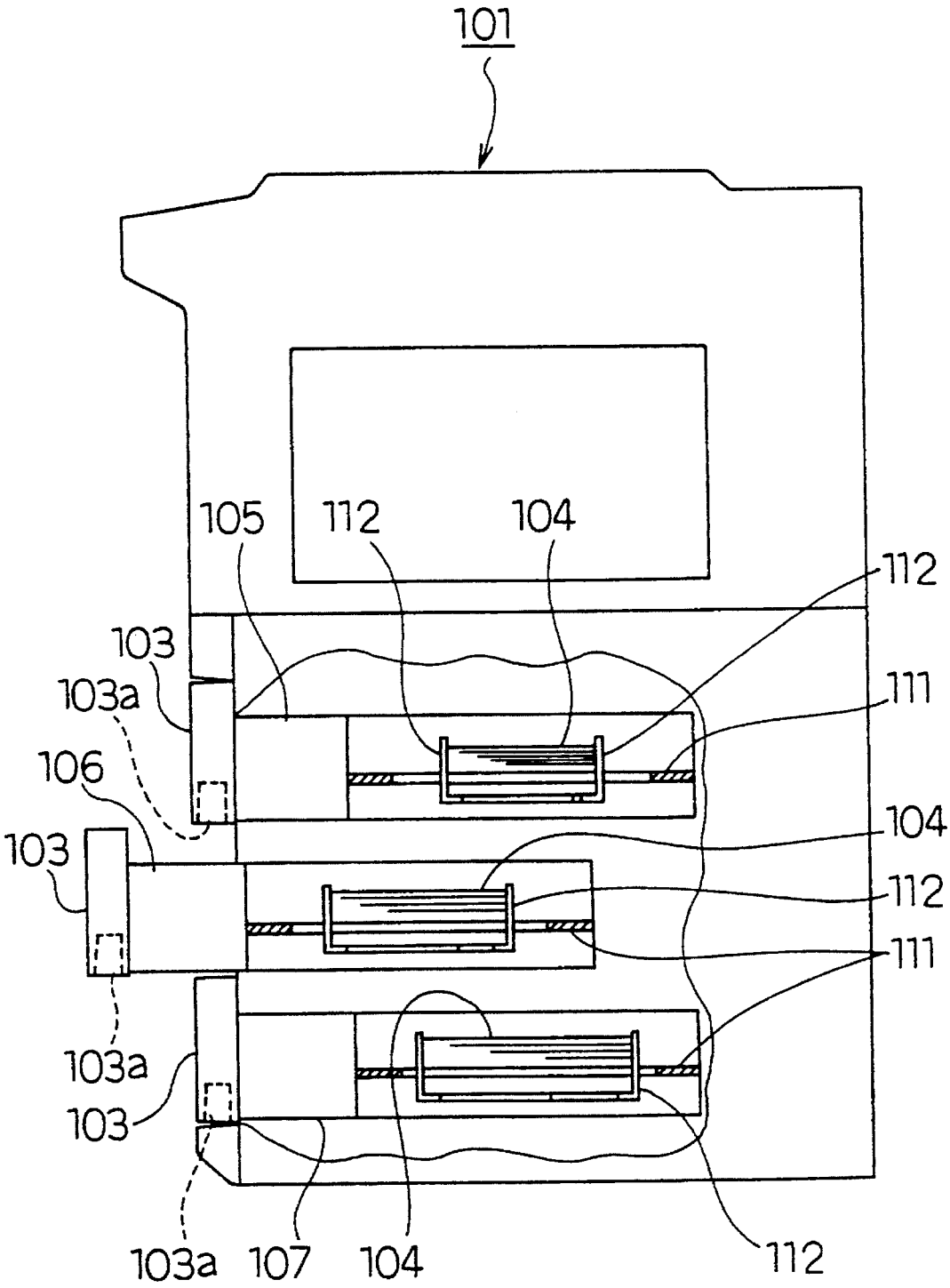
Fig. 2 PRIOR ART
FIG. 2 is a partially cut-away section showing the body of copying machine of the prior art, as taken from the righthand side.
Figure 6:
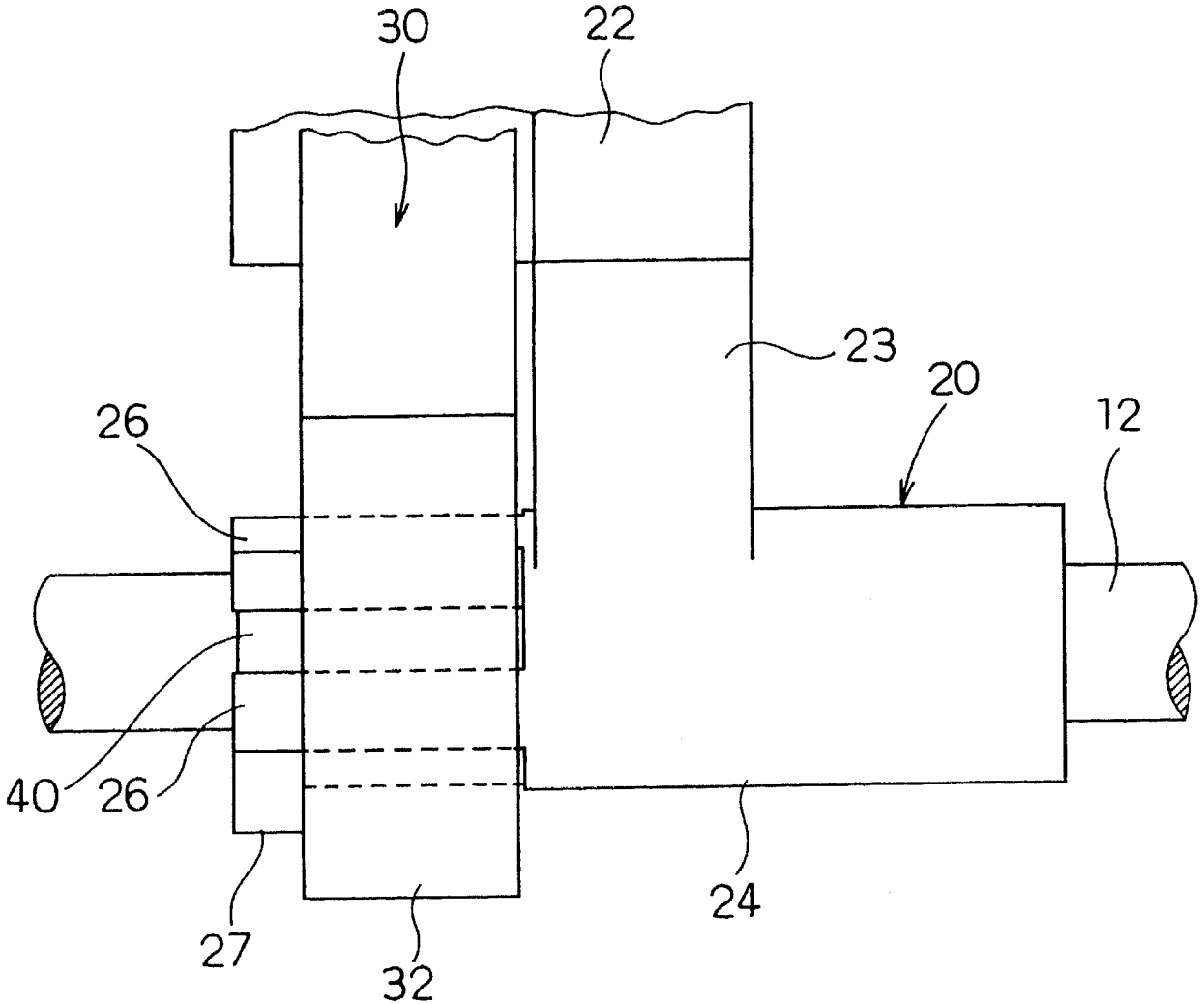
Figure 7:
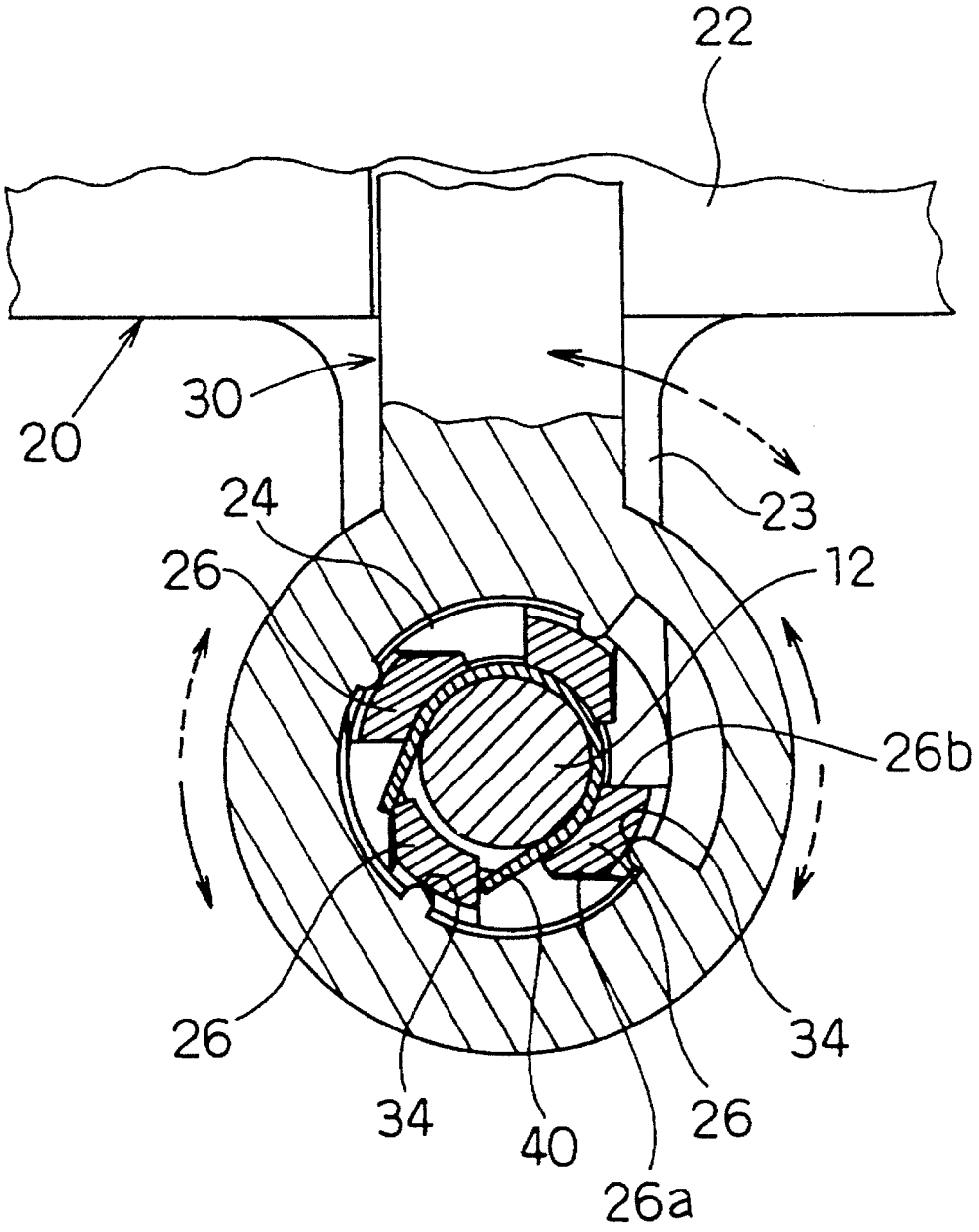

FIG. 6 is an enlarged side elevation showing an essential portion of the invention, as taken in the direction normal to FIG. 2, FIG. 7 is an enlarged section of an essential portion of the invention showing the paper stopper of FIG. 5 in a fixed position.

Designations of Reference Characters

| | |
|---|---|
| 100 | Paper Cassette Body |
| 12 | Support Pin |
| 14 | Inner Bottom Face |
| 16 | Through Groove |
| 20 | Paper Stopper |
| 22 | Paper Abutment Portion |
| 24 | Sliding Sleeve |
| 26 | Clamping Member |
| 30 | Control Lever |
| 32 | Cylindrical Fitting Portion |
| 34 | Push Projection |
| P | Paper Sheet |

PREFERRED EMBODIMENTS

An embodiment of the present invention according to the present invention will be described in the following with reference to the accompanying drawings.

Figure 1:
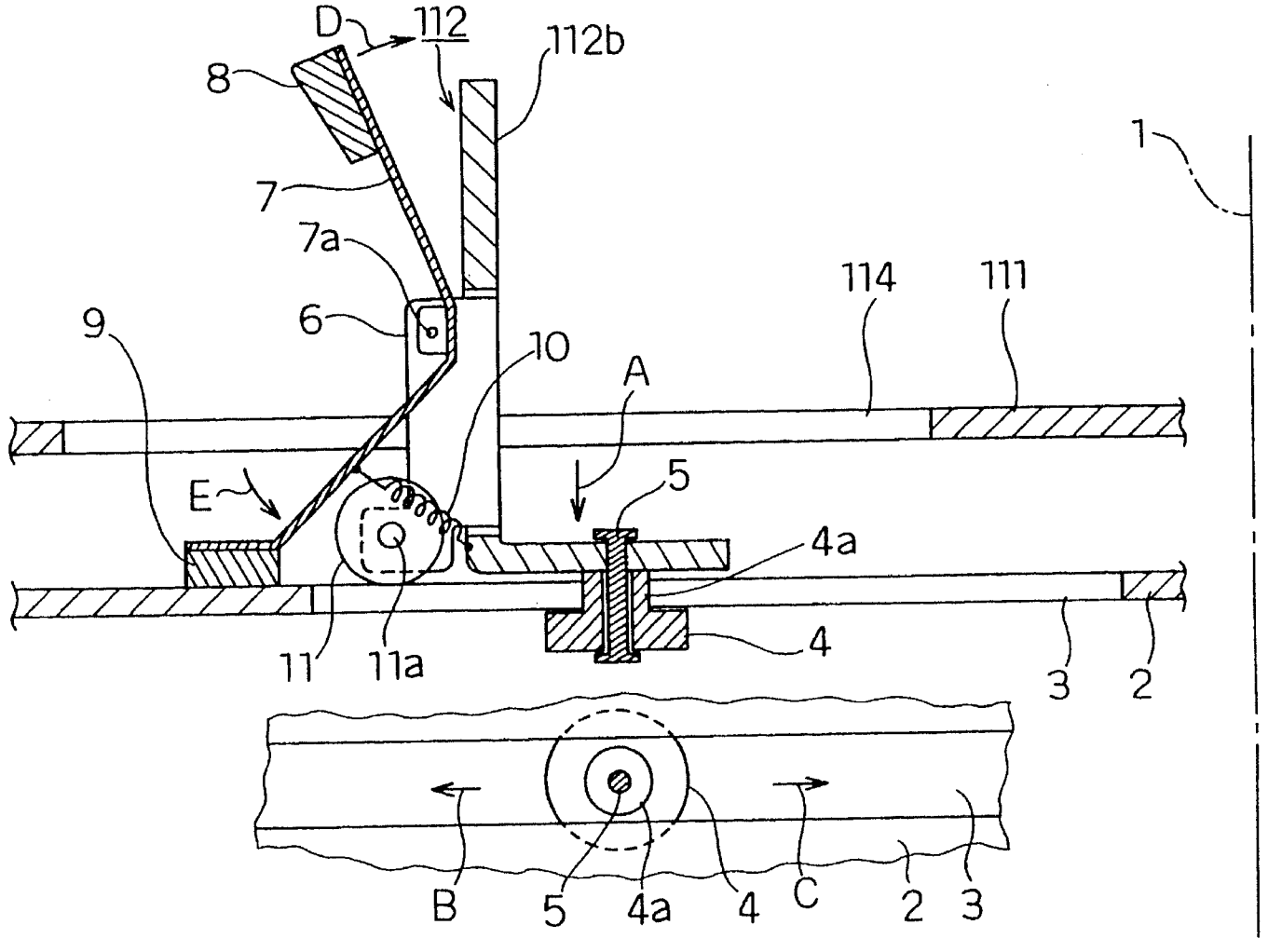
FIG. 1(*a*) is a schematic section showing a paper regulating mechanism according to one embodiment of the present invention.

FIG. 1(*a*) is a schematic section for explaining the construction of a paper regulating mechanism according to one embodiment of the present invention, and FIG. 1(*a*) is a schematic top plan view, showing the paper regulating mechanism of FIG. 1(*a*), as taken in the direction of arrow A. With reference to these Figures, the construction of the present embodiment will be described in the following.

Figure 3:
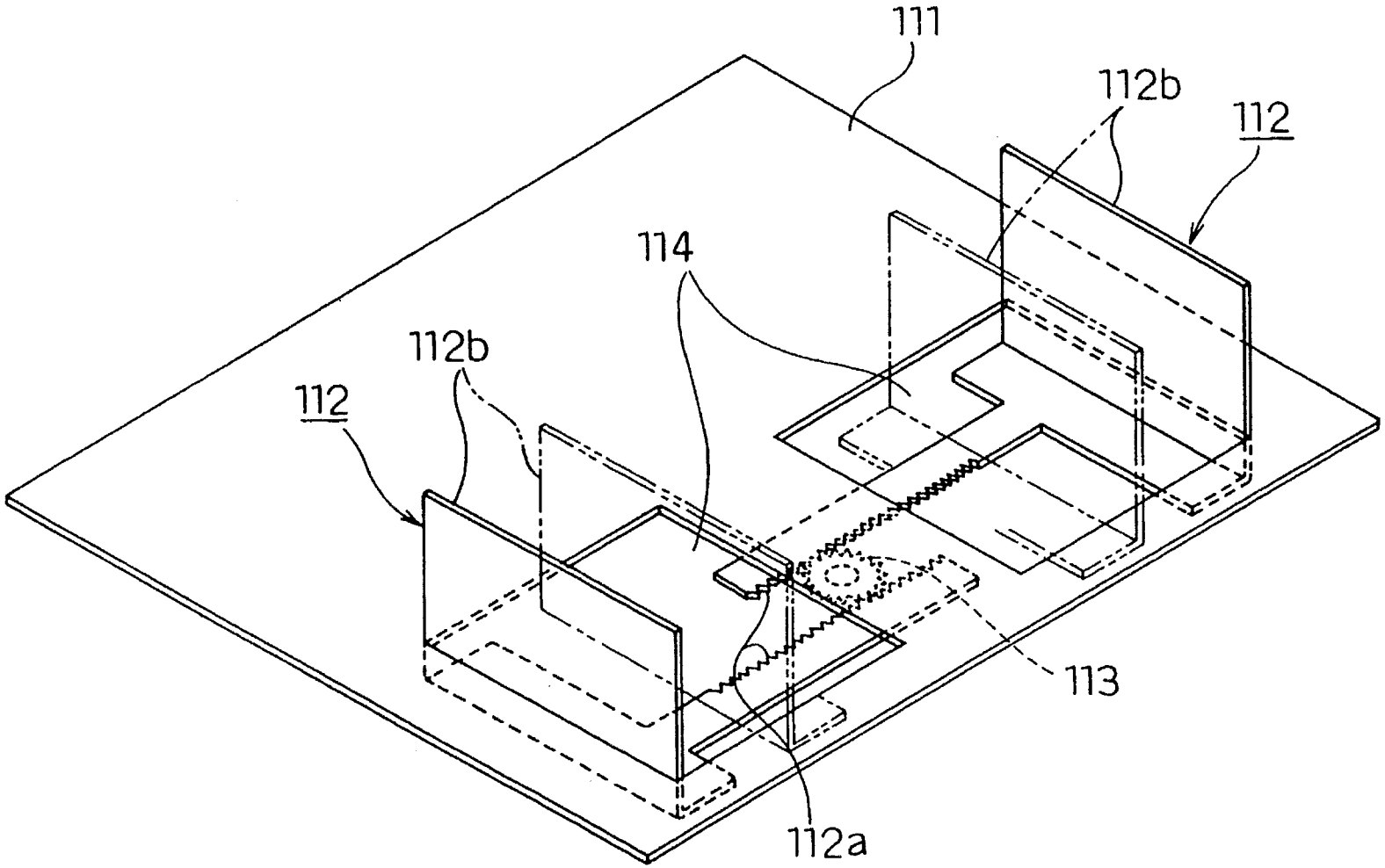
Fig. 3 PRIOR ART
FIG. 3 is a schematic perspective view showing a paper feed cassette shown in FIG. 2.

Incidentally, the paper regulating mechanism of the present embodiment has an axially symmetric shape in which the paper feeding direction is used as the axis of symmetry. Hence, FIG. 1(*a*) shows only one side of the symmetric shape, and the parts having functions similar to those of FIGS. 2 and 3 are designated at the same reference characters.

As shown in FIG. 1(*a*), a bottom plate 111 is a plate for setting a paper sheet 104 and is formed with a pair of openings 114 which has an axis of symmetry in the paper feeding direction at its central portion (wherein the axis of symmetry 1 is shown as perpendicular to the aforementioned paper feeding direction so that the construction is identical even if it is deemed symmetric for its description with respect to the axis of symmetry 1, as will be described in the following). A regulation guide member 2 is disposed below the bottom plate 111 and formed with a slit 3 having a predetermined width in a position generally corresponding to that of the opening 114. A paper regulating plate 112 generally exhibits the letter "L" shape. In the central portion of the bottom of the horizontal portion of the paper regulating plate 112, there is rotatably mounted by a holding pin 5 a stepped roller 4 which has a coaxial step. In addition, a (not-shown) rack portion 112 is provided as in the prior art. On the other hand, paper regulating portions 112*b*, which are located at the vertical portions of the paper regulating plates 112 generally having the letter "L" shape so that they act as the upper plate portions of the present invention, are protruded upward from the upper faces of the bottom plate 111, are brought into abutment against the end faces of the paper sheet 104 at the sides facing the axis of symmetry 1, to regulating the position of the paper sheet 104. Moreover, the paper regulating portions 112*b* are individually formed at their righthand and lefthand side edges with brackets 6 and 6 forming part of the lock means of the present invention, which are cut up from the side edges away from the axis of symmetry 1. Incidentally, FIG. 1(*a*) presenting a section shows the inner side of only one bracket 6. Here, the horizontal portions of the paper regulating plates 112 and the stepped rollers 4 mounted in the central portions of the bottoms of the same correspond to the lower guided portions of the present invention. Between the two levers 6, there is arranged a plate-shaped lever 7 which is bent at an obtuse angle away from the paper regulating portions 112*b* to generally have a Japanese letter "∧" shape. The lever 7 is hinged to the individual upper positions of the brackets 6 by hinge pins 7*a*. Moreover, a protection portion 8 to be pinched by the fingers of an operator is attached to the upper leading end portion of the lever 7, and a nonslip member 9 of rubber is attached to the lower leading end portion of the same at the opposite side. The nonslip member 9 can come into facial contact with the regulation guide plate 2 to fix the paper regulating plate 112 in an arbitrary position. To the center of the lever 7 below the hinge pin 7*a*, on the other hand, there is attached a lock spring 10 for biasing the nonslip member 9 to the face of the regulation guide plate 2 at all times. The other end of this lock spring 10 is fixed on the paper regulating portion 112*b*. Below the bracket 6, moreover, there are disposed a pair of rollers 11 which are made rotatable on their shafts. The rollers 11 are slightly raised by a predetermined size from the bottom faces of the horizontal portion of the paper regulating plate 112. In this state, the stepped roller 4 has its step portion 4*a* slidably fitted in the slit 3. In case the nonslip member is not pushed onto the face of the regulation guide plate 2, i.e., released from its locked state, the roller 4 can smoothly slide in the direction of the slit 3 (i.e., in the direction of arrow B or C, as shown in FIG. 1(*b*)). Here, the lock means of the present invention includes the lever 7, the nonslip member 9 and the lock spring 10. Here, the FIG. 1(*b*) is a schematic top plan view, as taken in the direction of arrow A while centering the portion of the stepped roller 4 of FIG. 1(*a*).

With the construction thus far described, the operations of the present embodiment will be described in the following with reference to these Figures.

For example, when the operator is about to change the size of the paper sheets 104 to be accommodated in the paper feed cassette, from the A4 size to the B5 size, he takes out at first all the paper sheets 104 of A4 size stored already. Then, he places a predetermined number of paper sheets 104 of B4 size on the bottom plate 111 at a central portion of the paired paper regulating plates 112. In order to narrow the gap of the paired paper regulating portions 112*b* to the width of the paper sheets, the protection portions 8 attached to the individual paper regulating plates 112 are pinched by the fingers toward the paper regulating portions 112*b* (i.e., in the direction of arrow D). Since the locked state of the paper regulating plates 112 by the nonslip member 9 or the like can be released only while the protection portions 8 are being pinched, the individual paper regulating plates 112 are slit toward the axis of symmetry 1 (i.e., in the direction of arrow C shown in FIG. 1(*b*) as to the paper regulating plate 112 shown in FIG. 1(*a*)) so that the roller 11 can smoothly move while rolling on the surface of the regulation guide plate 2. The protection portions 8 are released after it has been confirmed that the two paper regulating portions 112*b* come into correct abutment against the end portions of the paper sheets 104. When the protection portions 8 are released from the fingers, the lever 7 is turned in the direction of arrow E by the restoring force of the lock spring 10. As a result, the nonslip members 9 have their surfaces urged by the predetermined force onto the surface of the regulation guide plate 2 so that the movements of the paper regulating plates 112 are blocked by the frictional forces on the surfaces.

Thus, the width adjustment of the paper regulating plates 112 is completed so that the paper sheets 104 can have their width adjusted by far smoother motions of the rollers 11 than those of the prior art. By the lock means, moreover, the paper regulating plates can be reliably fixed, if necessary, to cause no slip of the paper sheets 104.

Although the present invention has been described in case the rollers are attached to the paper regulating portions 112*b* as in the embodiment, it should not be limited thereto but can naturally be modified such that the rollers are attached to the bottom face of the horizontal portions of the paper regulating plates 112.

Although the present invention has been described in case the upper plate-shaped portions and the lower guided portions of the present invention are made into a unitary structure as the generally "L"-shaped paper regulating plates 112, it should not be limited thereto but can naturally adopt different structures.

Moreover, the present invention can be applied not only to the copying machine but also any device if this device is exemplified by a printer equipped with a paper regulating mechanism.

As is now apparent from the description thus far made, the present invention is advantageous in that the upper plate-shaped portions can be smoothly moved even by a weak force to make the paper exchanging operation easier than those of the prior art while preventing the slip of the paper sheets reliably.

Here will be described an embodiment of the paper cassette according to the present invention with reference to the accompanying drawings.

FIG. 4 shows an overall structure of the paper cassette of the present embodiment. In the paper cassette body 100 having a shape of shallow rectangular shape, there are stacked paper sheets P to be used. These paper sheets P will not slip at their front and side end faces abutting against the inner walls of the paper cassette body 100 but may slit at their rear end faces kept away from contact with the inner walls of the paper cassette body 100. This slip at the rear end faces of the paper sheets P is prevented by applying a paper stopper 20.

The paper cassette body 100 is formed in its inner bottom face 14 with a through groove 16 extending centrally of the longitudinal direction, in which is disposed a support shaft 12. These through groove 16 and support shaft 12 are extended forward from the rearmost portion to midway of the front of the paper cassette body 100 so that the paper stopper 20 is allowed to move within the range in which the through groove 16 and the support shaft 12 are arranged.

The paper stopper 20 is composed of: a paper abutment portion 22 raised vertically upward from the inner bottom face 14 of the paper cassette body 100; and a sliding sleeve 24 formed to extend downward from the paper abutment portion 22 and fitted on the support shaft 12. On the sliding sleeve 24, there is fitted a cylindrical fitting portion 32 of a control lever 30, which can be turned clockwise and counterclockwise at the back side of the paper abutment portion 22. This control lever 30 is controlled to fixe and release the paper stopper 20.

FIGS. 5 to 7 show the mounting structure of the paper stopper 20 in detail.

This paper stopper 20 is connected to the sliding sleeve 24 through a joint portion 23 extending downward from the lower end of the paper abutment portion 22. The sliding sleeve 24 has its cylindrical face slitted axially from the end face into four clamping members 26. In the sectional shape of these clamping members 26, one end side 26*a* is so obliquely cut away that it is sloped from the center to leave toward the outer circumference with respect to the radial direction. The other end side 26*b* is arranged generally in parallel with the radial direction.

The sliding sleeve 24 is fitted at such a gap around the support shaft 12 as to allow smooth sliding motions of the two. Between the inner faces of the clamping members 26 and the support shaft 12, there is arranged a sheet member 40 which is bent into a U-shape. In this state, too, the clamping members 26 and the sheet member 40 can freely slide with respect to the support shaft 12.

The cylindrical fitting portion 32 of the control lever 30 is fitted on the outer circumferences of the clamping members 26 of the sliding sleeve 24. The leading end of the control lever 30 extending radially of the cylindrical fitting portion 32 is turned in the back space of the paper abutment portion 22 from the inclined position to the vertical direction. The cylindrical fitting portion 32 has an internal diameter slightly larger than the external diameter of the sliding sleeve 24 and the clamping members 26 and is formed on its inner face at four circumferentially equidistant portions with push projections 34 which have a semicircular section and extend all over the longitudinal direction.

With the control lever 30 being inclined, as shown in FIG. 5, the push projections 34 are arranged in the gap space between the clamping members 26. When the control lever 30 is brought into its upright position, as shown in FIG. 7, the push projections 34 arranged just on the outer circumferences of the clamping members 26.

One of the clamping members 26 of the sliding sleeve 24 is formed at its end portion with a sector- shaped stopper member 27 which is extended to the outer circumferential side. When this stopper member 27 comes into engagement with the circumferential edge of the cylindrical fitting portion 32 of the control lever 30, the cylindrical fitting portion 32 is prevented from coming out of the sliding sleeve 24. The cylindrical fitting portion 32 is formed in its inner face with a sector-shaped recess 36 between the push projections 34. When the control lever 30 is arranged to adjust the recess 36 to the position of the stopper member 27 of the sliding sleeve 24, the cylindrical fitting portion 32 can be fitted on and removed from the sliding sleeve 24.

Here will be described the operations of the paper stopper 20 having the structure described above.

With the control lever 30 being inclined, as shown in FIG. 5, the paper stopper 20 is moved along the support shaft 12 until it is positioned to abut against the end portions of the paper sheets P accommodated in the paper cassette body 100. If the paper sheets P to be used have a regular size such as A4 or A3, it is convenient to make a position mark indicating each paper size on the inner bottom face 14 of the paper cassette body 100. If the inner bottom face 14 of the paper cassette body 100 and the paper abutment portion 22 of the paper stopper 20 are formed at every positions of the aforementioned regular paper sheets with click engagement portions which include projections and grooves to removably engage with each other, the individual regular paper sheets can be easily positioned.

When the control lever 30 is then turned to the vertical position (as indicated by solid arrows in FIG. 7), the push projections 34 move from the sloped end sides of the clamping members 26 and rise on the outer circumference of the clamping members 26 to push these clamping members 26 toward the center. Then, these clamping members 26 are pushed to the support shaft 12 through their inner sheet member 40 so that the clamping members 26, i.e., the paper stopper 20 including the sliding sleeve 24 is fixed on the support shaft 12. Since, in this state, the frictional holding force is also applied between the clamping members 26 and the push projections 34 by the reaction of the clamping members 26, there arises no fear that the control lever 30 may turn in a falling direction. Incidentally, that sheet member 40 is not indispensable.

When the size of the paper sheets P to be accommodated in the paper cassette 100, the control lever 30 is turned in the falling direction (as indicated by dotted lines in FIG. 7). Then, the push projections 34 are returned from the positions, in which they abut against the outer circumference of the clamping members 26, to the gap spaces of the clamping members 26 so that the pushing force of the support shaft 12 by the clamping members 26 disappears. As a result, the paper stopper 20 can be freely moved along the support shaft 12.

As has been described hereinbefore, according to the present invention, the paper cassette body is formed into the shallow rectangular container or box capable of accommodating and stacking the paper sheets to be used. This paper cassette body is equipped in its bottom portion with the horizontally extending support shaft. This support shaft is mounted to match the range in which the paper stopper is to be moved. The support shaft is preferably disposed at a position lower than the inner bottom face of the paper cassette body so that it may be kept away from abutting against the paper sheets when these sheets are accommodated in the paper cassette body. In this case, however, the inner bottom face of the paper cassette body has to be formed over the moving range of the paper stopper with the through groove allowing a portion of the paper stopper to pass therethrough. If the support shaft is arranged in parallel with the direction in which the paper sheets are to be fed out of the paper cassette, the position of the paper stopper to come into abutment against the rear end of the paper sheets can be longitudinally adjusted. If the support shaft is arranged in a direction perpendicular to the same, the position of the paper stopper to come into contact with the side end of the paper sheets can be transversely adjusted. The support shaft and the paper stopper can be arranged in the two directions, i.e., in the longitudinal and transverse directions.

The paper stopper is equipped with the paper abutment portion which is raised upright to come into abutment against the end portions of the paper sheets stacked and accommodated in the paper cassette body. This paper abutment portion may have a shape and a construction similar to those of the paper stopper in the ordinary paper cassette. This paper abutment portion is arranged above the inner bottom face of the paper cassette. The paper abutment portion is equipped at its lower end with the sliding sleeve which is to be fitted on the aforementioned support shaft. The sliding sleeve may preferably be arranged below the inner bottom face of the paper cassette so that it may not be caught by the paper sheets and so that the joint portion between the sliding sleeve and the paper abutment portion may pass through the through groove which is formed in the inner bottom face of the paper cassette.

The sliding sleeve is equipped with the clamping members which are separated by the axial slits from its cylindrical face. These clamping members have their length and width so preferably designed that they can be easily deformed and that they can exert the suitable clamping force of suitable magnitude upon the support shaft. Therefore, the clamping members are preferably made of a synthetic resin which is excellent in elastic deformability. Even if a single clamping member could perform the function to some extent, it is preferred for ensuring the clamping actions to provide a plurality of clamping members circumferentially equidistantly of the sliding sleeve. The clamping members are formed with such gaps or slits between their adjacent ones as can arranged the push projections of the later-described control lever. If the end sides of the clamping members, against which the push projections of the control lever are to come into abutment, are angled at a gentle slope or rounded, the operations can be smoothed.

On the outer circumference of the clamping members of the sliding sleeve, there is rotatably fitted the cylindrical fitting portion of the control lever. This control lever is preferably extended upward from the cylindrical fitting portion so that it can be turned above the inner bottom face of the paper cassette. In order that the cylindrical fitting portion of the control lever may not come out of the sliding sleeve, it is preferable to provide the stopper structure between the cylindrical fitting portion and the sliding sleeve.

The cylindrical fitting portion is formed on its inner face with the push projections rising radially inward. These push projections have their height and positions set such that they push the clamping members toward the center to push the inner faces of the clamping members onto the support shaft, when they come into abutment against the outer circumferences of the clamping members of the sliding sleeve. As the push projections are given the larger height, the pushing force from the clamping members to the support shaft, i.e., the force for fixing the position of the paper stopper becomes the stronger but requires the higher force for the operations.

As has been described hereinbefore, in the paper cassette according to the present invention, the paper stopper is slidably mounted on the support shaft which is disposed in the paper cassette body, and can be fixed or released merely by turning the control lever at an arbitrary position.

As has been apparent from the description thus far made, according to the present invention, the paper stopper can be remarkably simply moved, when the paper size is to be changed, and can cover not only a predetermined paper size but also an arbitrary paper size easily. As a result, the kinds of paper to be covered by one paper cassette can be drastically increased.

What is claimed is:

1. A paper cassette comprising: a paper cassette body for accommodating stacked paper sheets; a paper stopper for abutting against the end portions of the paper sheets stacked in said paper cassette body; and a support shaft horizontally extending in a through groove formed in the bottom portion of said paper cassette body, wherein said paper stopper includes a paper abutment portion erected upright, and a sliding sleeve fitted on said support shaft at the lower end of said paper abutment portion, wherein said sliding sleeve has clamping members separated by axial slits from a cylindrical fitting portion thereof, wherein a control lever has said cylindrical fitting portion fitted rotatably on the outer circumferences of said clamping members, and wherein said cylindrical fitting portion is formed with push projections raised radially inward from the inner face of said cylindrical fitting portion.

2. A paper cassette according to claim 1, wherein said clamping members side ends, against which the push projections of said control lever come into abutment, are rounded with a gentle slope.

3. A paper cassette according to claim 1, wherein said control lever is extended upward from said cylindrical fitting portion so that it can be turned above the inner bottom face of said paper cassette.

4. A paper cassette according to claim 1, wherein further comprising a stopper structure interposed between said cylindrical fitting portion and said sliding sleeve for preventing the cylindrical fitting portion of said control lever from coming out of said sliding sleeve.

5. A paper cassette according to claim 4, wherein said stopper structure includes a sector-shaped stopper member extending radially outward to the end portion of one of the plurality of clamping members of said sliding sleeve, whereby said stopper member comes into engagement with the circumferential edge of the cylindrical fitting portion of said control lever to prevent said cylindrical fitting portion from coming out of said sliding sleeve.

* * * * *